United States Patent [19]

Albrecht et al.

[11] 4,350,105

[45] Sep. 21, 1982

[54] SEWING MACHINE WITH A DEVICE FOR LUBRICATING THE LOOPER

[75] Inventors: Ernst Albrecht, Hochspeyer; Reiner Hensel, Trippstadt; Karl-Heinz Keller; Horst Stahlschmitt, both of Kaiserslautern, all of Fed. Rep. of Germany

[73] Assignee: Pfaff Industriemaschinen GmbH, Fed. Rep. of Germany

[21] Appl. No.: 165,615

[22] Filed: Jul. 3, 1980

[30] Foreign Application Priority Data

Jul. 12, 1979 [DE] Fed. Rep. of Germany ..... 2928077

[51] Int. Cl.[3] ..... D05B 71/02

[52] U.S. Cl. ..... 112/256; 184/6.15; 184/56 R

[58] Field of Search ..... 184/6.15, 6.26, 56 A, 184/56 R, 58, 102; 112/256

[56] References Cited

U.S. PATENT DOCUMENTS

| | | | |
|---|---|---|---|
| 2,417,403 | 3/1947 | Zones | 184/56 R X |
| 2,939,415 | 6/1960 | Wrase | 112/256 |
| 2,961,984 | 11/1960 | Reeber et al. | 184/6.15 X |
| 3,064,606 | 11/1962 | Terayama et al. | 184/6.15 X |
| 3,146,745 | 9/1964 | Schenkengel | 184/6.15 X |
| 3,188,010 | 6/1965 | James | 184/56 A X |
| 3,254,740 | 6/1966 | Bono | 112/256 X |
| 3,272,164 | 9/1966 | Keller | 184/6.15 X |
| 3,513,794 | 5/1970 | Bernewasser | 112/256 |
| 3,769,925 | 11/1973 | Von Hagen | 112/256 |
| 4,095,541 | 6/1978 | Dunn et al. | 112/256 |

*Primary Examiner*—David H. Brown

*Attorney, Agent, or Firm*—McGlew and Tuttle

[57] ABSTRACT

A looper lubricating device for a sewing machine includes an oil line having an inlet submerged within an oil supply and a capillary member within the oil line at a spaced location from the inlet and the oil supply. An outlet of the oil line is in fluid communication with an injection nozzle and the capillary member protrudes through the outlet of the oil line into a mixing chamber within the injection nozzle. A gas conduit communicating with the mixing chamber is operative to intermittently produce a pressure gradient between the inlet and the outlet of the oil line to pass oil to the mixing chamber.

8 Claims, 2 Drawing Figures

SEWING MACHINE WITH A DEVICE FOR LUBRICATING THE LOOPER

FIELD AND BACKGROUND OF THE INVENTION

The present invention relates in general to a sewing machine and, more particularly, to an improved device for lubricating a sewing machine looptaker.

A looptaker lubricating device is disclosed in West German Pat. No. 22 50 015 of the type having a looper arranged above a workpiece in a swivel arm and a cloth-clamping frame which moves in dependence on the movement of the swivel arm. The looptaker lubricating device has a capillary means, arranged in an oil line that has one end which dips into the oil of an oil storage vessel and another end which is movably mounted on the housing of the sewing machine. When the cloth-clamping frame is lifted, the moving end of the capillary means is swivelled in an exposed area of the bearing fin of the bobbin cage and feeds a small amount of oil to the bearing fin.

The fact that the capillary means is only pressed on the bearing fin of the bobbin case when the sewing machine stands still assures, on the one hand, a sufficient oil supply to the looper, and on the other hand, avoids an excess supply of oil during the operation of the sewing machine. Since the cloth-clamping frame is raised when the sewing machine is turned off, the capillary means during the entire stationary period bears on the bearing fin of the bobbin case. Since the capillary means connects the oil storage vessel with the bearing fin of the bobbin cage, the capillary means constantly draw some oil off from the storage vessel and delivers it to the bearing fin. During extended standstill periods, therefore, the bobbin cage, and thus the looptaker, can be flooded with oil.

In a looptaker device disclosed in U.S. Pat. No. 2,417,403, the looptaker of a sewing machine is lubricated with an oil mist through the hollow looper shaft. The lubricating device contains an injector nozzle with a mixing chamber which has two inlets and one outlet opening into the hollow looper shaft. One inlet of the mixing chamber is connected to a compressed air source which can be turned on and off by means of a manually operated valve. The other inlet is connected to a suction pipe into which the outlet of a drip oiler opens. The drip oiler has a valve with an adjustable flow cross-section that can be completely closed by means of a lever. The compressed air flowing through the injector nozzle produces a vacuum in the mixing chamber so that air and oil drops, dripping from the air oiler, are sucked in through the suction pipe. The oil drops are whirled by the compressed air to form an oil mist which flows through the hollow looper shaft in the looper and lubricates its bearing surfaces.

Since the oil supply can be completely isolated in this lubricating device by closing the oiler, the looptaker can thereby be prevented from being flooded with oil during longer standstill periods. This requires however, that an operator actually close the valve at the start of a longer standstill period. Otherwise the drip oiler will constantly drip, even with the sewing machine turned off, and the oil will eventually fill the suction pipe, the mixing chamber and the hollow looptaker shaft, leading to flooding of the looper when the machine is again turned on. Since compressed air flows constantly in a running sewing machine through the injector nozzle, and thus through the looptaker, the tendency to cast off small oil droplets which exist anyway in rapidly rotating loopers due to the centrifugal force, is increased further. Therefore, there is a risk that the sewing machine and the sewing material will be soiled by cast-off oil droplets.

SUMMARY OF THE INVENTION

The invention is based on the problem of providing a sewing machine with a looptaker-lubricating device wherein the looper is not flooded with oil even during prolonged standstill periods, and no oil is cast off from the looptaker.

In accordance with the invention, an improved device for lubricating the looptaker of a sewing machine includes a storage vessel for containing a supply of oil, an injection nozzle having a mixing chamber for mixing a gas and the oil to form an oil mist and a discharge opening communicating with the chamber for passing the oil mist to the looper, and an oil line having a bore extending therethrough from an inlet submerged within the supply of oil to an outlet in fluid communication with with mixing chamber, capillary means mounted within the bore coextensive over a zone of the oil line from a distance spaced from the inlet and the oil of the storage vessel and having an end portion protruding through the outlet into the mixing chamber, and means for intermittently injecting the gas under pressure into the mixing chamber such that a pressure gradient is created between the inlet and the outlet of the oil line and oil is passed into the oil line from the supply of oil.

In operation, air briefly flows through the injector nozzle, with the looper and thus with the sewing machine standing still, breaks oil drops loose from the end of the capillary means protruding into the mixing chamber. The oil drops are whirled in the compressed air to form an oil mist. The amount of oil taken from the capillary means is replenished through the other end of the capillary means from the storage vessel by a pressure gradient between the air pressure in the storage vessel and the air pressure in the oil line. Due to the pressure gradient, the oil rises in the oil line up to the end of the capillary means facing the storage vessel. The pressure gradient can be produced, for example, by producing a vacuum in the oil line, while the storage vessel is under atmospheric pressure. It would also be possible to produce an excess pressure in the storage vessel while the oil lining under atmospheric pressure, or both possibilities could be used simultaneously.

The oil in the storage vessel can only come in contact with the capillary means when a pressure gradient exists, and the pressure gradient is only briefly produced or maintained, so that there is no possibility that the oil storage vessel will be evacuated over the capillary means in longer standstill periods, and thus flood the looper with oil.

Since compressed air only flows through the injector nozzle when the looptaker is stationary, the droplets of the oil mist can be applied to the bearing surfaces of the looper much easier than if the lubrication were effected with the looptaker rotating. Consequently, an adequate lubricating effect is achieved with the lubricating device according to the invention even with small amounts of oil, and the risk of oil being cast off is reduced.

According to another feature of the invention, the capillary means fills only a part of the cross-section of the oil line, so that air can also flow through the oil line, apart from the oil flowing inside the capillary means. As a result, the vacuum produced in known manner in the mixing chamber during the operation of injector nozzles, continues through the oil line down to the end, which extends into the oil of the storage vessel. In This way, a pressure gradient is produced without any auxiliary means between the storage vessel, which is under atmospheric pressures, and the oil line, which is necessary to raise the oil into the oil line. The pressure is in effect as long as compressed air flows through the injector nozzle.

According to another feature of the invention, the outlet end of the line carrying the compressed air is displaceable inside the injector nozzle relative to the end of the capillary means arranged in the mixing chamber. By varying the distance between the outlet end of the air line and the end of the capillary means, the amount of oil which the compressed air current can take from the capillary means can be dosed in a simple manner.

According to still another feature of the invention, the outlet orifice of the injector nozzle in a sewing machine with a stopping mechanism is arranged in the immediate proximity of an area of the bearing fin of the bobbin cage which is exposed when the looptaker stands still. In this way, the oil is brought to the part of the looper standing still, even when the sewing machine is running, that is, to the bearing fin of the bobbin cage, so that the oil deposited here does not take part in the rotation of the looptaker. The looper entrains only as much oil as adheres to the bearing surface of the looptaker, due to the adhesion of the oil. Therefore, the possibility that the looptaker will cast off oil is further reduced.

It is a further object of the invention to provide an improved device for lubricating a looptaker of a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF PREFERRED EMBODIMENT

Figure 1:
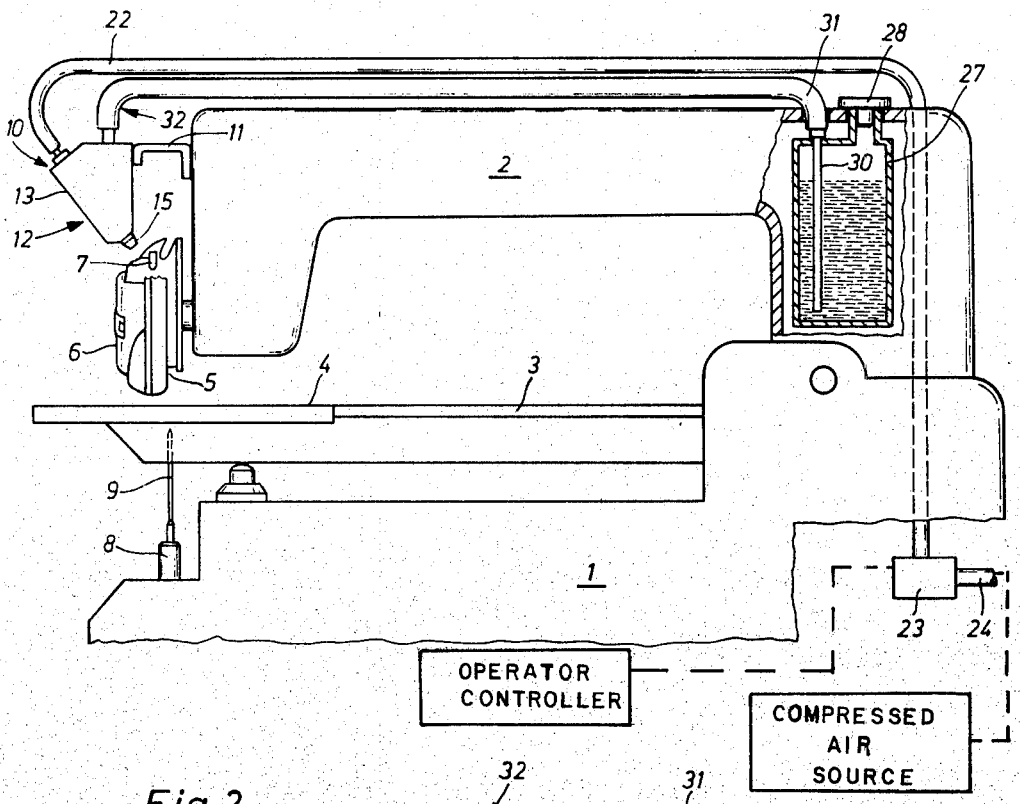
FIG. 1 illustrates a sewing machine, partly in section, with the lubricating device according to the invention.
Figure 2:
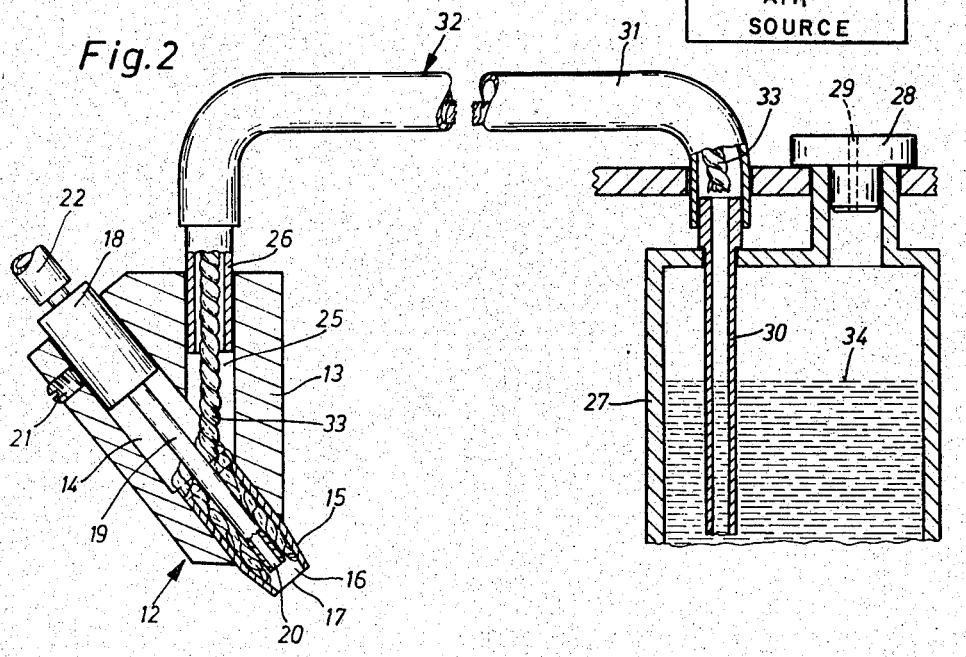
FIG. 2 illustrates the lubricating device of the invention in an enlarged sectional view.

The represented sewing machine is a buttonhole sewing machine, which has a sewing machine frame 1, a looper arm 2 pivotally mounted on the frame 1, and a likewise pivotally mounted cloth-supporting arm 3 having a cloth supporting plate 4 attached thereto. A revolving backstitch looptaker 5, hereafter simply called looptaker, is mounted on looper arm 2. The looper 5 has a non-rotatably mounted bobbin cage 6. Bobbin cage 6 carries a bearing fin 7 serving as a looper track. An ascending and descending needle bar 8 with a needle 9 in frame 1 is arranged underneath cloth-supporting plate 4. A stopping mechanism (not shown) has the effect that the sewing machine stops, after it has been turned off, with looptaker 5 and needle 9 always in the same position.

A lubricating device 10, which is provided for looptaker 5, has an injector nozzle 12 secured on looper arm 2 by means of a holder 11. Injector nozzle 12 consists of a housing 13 having an oblique continuous bore 14. A short piece of pipe 15, having an interior which forms a mixing chamber 16 and end opening facing looptaker 5 to form an outlet orifice 17 of injector nozzle 12, is inserted into the bottom of bore 14. In bore 14, there is also arranged a thin piece of pipe 19, provided with an extension 18, whose outlet orifice 20 is inside mixing chamber 16. Pipe 19 is detachably mounted in housing 13 by means of a screw 21, so that it is possible to displace pipe 19 axially and to vary the distance between outlet orifices 17 and 20.

On the upper end of pipe 19, a hose 22 is connected to the outlet of a known, and therefore only symbolically represented, shutoff-valve 23. Shutoff valve 23 is operated electromagnetically and is switched into open position when the sewing machine is stopped and looper arm 2 is raised by a limit switch (not shown). An adjustable timing element, designated as part of the schematically illustrated operator/controller, controls the opening time of shut-off valve 23. At the end of the adjusted time, shutoff valve 23 is switched back into closing position. The inlet of shut-off valve 23 is connected via a hose 24 to a compressed air source.

Housing 13 also contains a bore 25 which opens into bore 14. A socket 26 is provided in bore 25. An oil-filled storage vessel 27, which is closed by a plug 28, is arranged in looper arm 2. Plug 28 is provided with a through-bore 29, so that the interior of storage vessel 27 is under atmospheric pressure. A tube 30 is received in storage vessel 27. The lower end of tube 30 deeply extends into the oil. The upper end of tube 30 projects from storage vessel 27 and is connected through a hose 31 so that whereby tube 30, hose 31 and socket 26 form an oil line 32. A wick 33 is arranged in hose 31 as a capillary means and terminates at one end above tube 30, at a vertical distance from oil level 34. The other end of wick 33 protrudes through socket 26 and bore 25 into mixing chamber 16, where it terminates in the vicinity of outlet orifice 20. The diameter of wick 33 is much smaller than the inside diameter of hose 31 and of socket 26 so that wick 33 only partly fills the flow cross-section of oil line 32. The end of wick 33 protruding into mixing chamber 16 is separated into fibers so that this part of wick 33 is permeable to air, even when it is saturated with oil.

The lubricating device works as follows. With the sewing machine running or completely turned off, shutoff valve 23 is always in closed position so that no compressed air can flow through hose 22 and injector nozzle 12. Not only storage vessel 27, but also oil line 32 are under atmospheric pressure. Thus, the oil contained in tube 30 has the same level as the remaining oil in storage vessel 27, and that the adjacent upper end of wick 33 has no contact with the oil in storage vessel 27.

After the sewing machine has been stopped, provided the sewing machine remains in the ready position, shutoff valve 23 is opened briefly so that compressed air flows through hose 22 and pipe 19. The compressed air issuing from outlet orifice 20 breaks oil droplets loose from oil-saturated wick 33 and whirls them inside mixing chamber 16, so that an oil mist is formed. The oil mist flows at high speed from outlet orifice 17 of injector nozzle 12 and impinges on an exposed area of bearing fin 7, after which the fine oil droplets of the oil mist are deposited in this area on bobbin cage 6.

The air current issuing from pipe 19 at high speed produces a suction or a vacuum in mixing chamber 16, which continues first through the unravelled end of wick 33 and through oil line 32 to storage vessel 27. Storage vessel 27 is thus under a higher pressure for the short time in which compressed air flows through injector nozzle 12 than oil line 32, so that the oil contained in tube 30 rises up to the upper end of wick 33 and wets this part of wick 33 with oil. From there the oil flows by the capillary action of wick 33 to the end of wick 33 protruding into mixing chamber 16, so that the amount of oil taken during the formation of the oil mist from the wick end is replenished.

Since shutoff valve 23 always remains closed when the sewing machine is running or completely turned off, and is only briefly opened, so that when the sewing machine is stopped but in ready position, the oil of storage vessel 27 comes into contact with wick 33. There is, therefore, no possibility that storage vessel 27 will be evacuated over wick 33 in prolonged standstill periods of the sewing machine, and thus flood looper 5 with oil.

Since the oil droplets of the oil mist are deposited on a part of looptaker 5 that is stationary, even while the sewing machine is running, namely on bobbin cage 6, looptaker 5 entrains only so much oil, even after the sewing machine has been turned on, as adheres to the bearing surface of looptaker 5 due to the adhesion of the oil. The risk that looptaker 5 will cast off oil is thus reduced to a minimum. Due to this advantage, the lubricating device 10 is particularly suitable for use in sewing machines where the needle is arranged underneath and the looptaker is placed above the sewing material, as in the represented embodiment.

A lubricating device, according to the invention could also be used just as well in sewing machines with the looper arranged underneath and the needle above the sewing material, particularly since electromagnetic valve 23 can be operated not only by elements of the sewing machine which are set in motion by stopping the sewing machine, for example, looper arm 2, but just as well by control means which are independent of the sewing machine, for example, in this way that the control circuit of the driving motor emits a switching pulse when the sewing machine is stopped.

While a specific embodiment of the invention has been shown and described in detail to illustrate the application of the principles of the invention, it will be understood that the invention may be embodied otherwise without departing from such principles.

What is claimed is:

1. An improved device for lubricating a looptaker of a sewing machine, comprising a storage vessel for containing a supply of oil, an injection nozzle having a mixing chamber for mixing a gas and the oil to form an oil mist and a discharge opening communicating with said chamber for passing the oil mist to the looptaker, an oil line having a bore extending therethrough from an inlet submerged within the supply of oil to an outlet in fluid communication with said mixing chamber, capillary means mounted within said bore coextensive over a zone of said oil line from a distance spaced from said inlet and the oil of the storage vessel and having an end portion protruding through said outlet into said mixing chamber, and means for intermittently injecting the gas under pressure into said mixing chamber such that a pressure gradient is created between said inlet and said outlet of said oil line and oil is passed into said oil line.

2. The improved device as set forth in claim 1, wherein said capillary means fills only a part of the flow cross-section of said oil line.

3. The improved device as set forth in claim 1, wherein said injection means comprises a conduit extending from a source of compressed gas and terminating in said mixing chamber adjacent said end portion, screw means connected to said injection nozzle and said conduit for securing said conduit for adjustment in said mixing chamber relative to said end portion.

4. The improved device as set forth in claim 3, wherein said capillary means comprises a wick.

5. The improved device as set forth in claim 4, wherein said oil line includes an end portion vertically extending in said storage vessel with said inlet submerged within the oil and said wick having an end disposed at a spaced distance above the oil.

6. The improved device as set forth in claim 1, wherein said injection nozzle includes a first bore for passing said oil to said mixing chamber and a second bore terminating in the mixing chamber at an oblique angle directed toward said discharge opening for discharging a stream of compressed gas into said mixing chamber and producing a partial vacuum to pass oil from said storage vessel to said mixing chamber.

7. The improved device as set forth in claim 6, wherein said injection means comprises a conduit extending from a source of compressed gas and terminating in said mixing chamber adjacent said end portion, screw means connected to said injection nozzle and said conduit for securing said conduit for adjustment in said mixing chamber relative to said end portion.

8. The improved device as set forth in claim 7, wherein said capillary means includes a wick, said end portion being partly disposed concentrically about a portion of said conduit in said mixing chamber.

* * * * *